US006650211B2

(12) United States Patent
Pimouguet

(10) Patent No.: US 6,650,211 B2
(45) Date of Patent: Nov. 18, 2003

(54) VALVE POSITION SWITCH

(75) Inventor: Olivier Denis Pimouguet, Luce (FR)

(73) Assignee: ASCO Controls, LP, Florham Park, NJ (US)

( * ) Notice: Subject to any disclaimer, the term of this patent is extended or adjusted under 35 U.S.C. 154(b) by 274 days.

(21) Appl. No.: 09/866,381

(22) Filed: May 25, 2001

(65) Prior Publication Data

US 2002/0175789 A1 Nov. 28, 2002

(51) Int. Cl.[7] ..... H01H 9/00
(52) U.S. Cl. ..... 335/205
(58) Field of Search ..... 335/205–208

(56) References Cited

U.S. PATENT DOCUMENTS

| | | | | |
|---|---|---|---|---|
| 3,176,097 A | 3/1965 | Wood | 200/87 |
| 3,268,684 A | 8/1966 | Keller et al. | 335/154 |
| 3,622,722 A | 11/1971 | Jackson et al. | 200/61.39 |
| 3,675,169 A | 7/1972 | Scholl | 335/205 |
| 3,873,789 A | 3/1975 | Ward | 200/61.41 |
| 4,204,180 A | 5/1980 | Usui et al. | 335/205 |
| 5,932,856 A | 8/1999 | Lopes et al. | 200/61.58 R |
| 5,999,072 A | 12/1999 | Slavik | 335/207 |
| 6,089,098 A | 7/2000 | Tylisz et al. | 73/722 |
| 6,090,123 A | 7/2000 | Culp et al. | 606/180 |

OTHER PUBLICATIONS

International Search Report for PCT Application No. PCT/US 02/13139 dated Aug. 19, 2002.

*Primary Examiner*—Ramon M. Barrera
(74) *Attorney, Agent, or Firm*—Howrey Simon Arnold & White LLP

(57) ABSTRACT

An electrical switch for indicating the position of a movable member of a valve is disclosed. The movable member of the valve may be a linear moving stem or a rotating shaft. The switch includes a sensor held in a sealed enclosure. The sensor may be a reed switch or a Hall effect sensor. A pivot arm attaches to the enclosure and is biased by a spring. The pivot arm holds a permanent magnet adjacent to the enclosure. When an actuator moves the movable member of the valve, the pivot arm is forced against the enclosure. The magnet is moved into aligned relation to the sensor and electrically indicates the position of the movable member.

23 Claims, 5 Drawing Sheets

VALVE POSITION SWITCH

FIELD OF THE INVENTION

The present invention relates generally to electrical switches and, more particularly to a sealed proximity switch for use with a movable member such as a valve stem.

BACKGROUND OF THE INVENTION

A valve position switch, such as a limit switch, is used to indicate the state, e.g., closed or open, of a valve that controls the flow of fluids. Typically, the valve has a linearly or rotatably movable member whose relative position relates to the state of the valve. The switch contacts the movable member of the valve when the member attains a particular position typically corresponding to a fully open or fully closed valve. The switch then provides electrical indication to a remote controller as to the state of the valve.

Ideally, the switch is substantially durable to sustain repeated contact with the movable member throughout its life. Because the switch may be susceptible to corrosive elements or fluids that may destroy the sensor within the switch, it is desirable that the switch has ample protection, seals and a minimal number of openings.

SUMMARY OF THE INVENTION

One aspect of the present invention provides an electric device for indicating a position of a movable member. The electric switch includes an enclosure, a lever, a permanent magnet, a biasing member and a sensor. The enclosure has a hermetically sealed chamber defined by a first wall and an adjacent second wall. The lever is pivotally attached to the first wall and holds the permanent magnet adjacent the second wall. The magnet is movable with the lever between a first and a second position. The biasing member biases the lever and magnet to the first position. The sensor is located within the chamber and is capable of being influenced by the magnet when it is moved into the second position through contact of the lever with the movable member.

Another aspect of the present invention provides a limit switch for indicating the state of a valve. The limit switch includes an enclosure, an arm, a holder, a magnet, a biasing member and a sensor. The enclosure has a sealed chamber defined by a first wall and an adjacent second wall. The arm has one end pivotally attached to the first wall. A receptacle on the arm for holding the magnet adjacent to the second wall. The biasing member is disposed between the arm and the first wall of the enclosure. The sensor is disposed in the chamber adjacent to the second wall and is magnetically influencable to indicate the position of the valve member when the magnet is pivoted with the arm into an aligned relation with the sensor.

Yet another aspect of the present invention provides a method for indicating a predetermined position of a movable member. The method includes attaching one end of an arm to a first wall of an enclosure; holding a magnet on the arm adjacent to a second wall of the enclosure; sealing a sensor within the enclosure adjacent to the second wall; pivoting the magnet in relation to the sensor by contacting the movable member with the pivot arm; electrically indicating that the movable member has attained the predetermined position when the magnet is in an aligned relation to the sensor; and biasing the pivot arm and the magnet away from the aligned relation to the sensor when the movable member is not at the predetermined position.

The foregoing summary is not intended to summarize each potential embodiment or every aspect of the invention disclosed herein, but merely to summarize the appended claims.

BRIEF DESCRIPTION OF THE DRAWINGS

The foregoing summary, preferred embodiments and other features or aspects of the invention will become apparent upon reading the following detailed description and upon reference to the drawings, in which.

Figure 1:
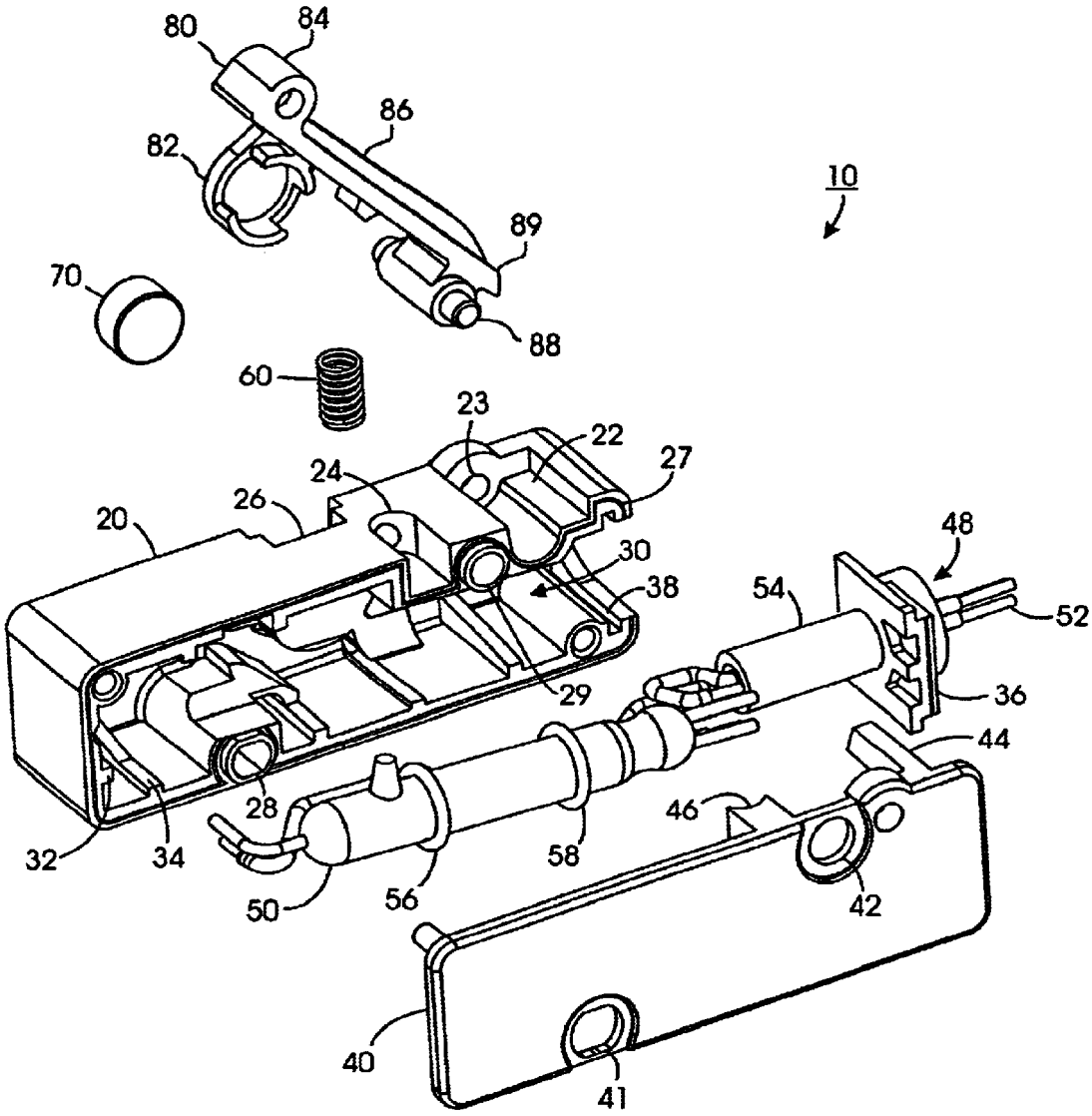
FIG. 1 illustrates an exploded view of an embodiment of a valve position switch according to the present invention.

While the invention is susceptible to various modifications and alternative forms, specific embodiments thereof have been shown by way of example in the drawings and are herein described in detail. The figures and written description are not intended to limit the breadth or scope of the invention in any manner, rather they are provided to illustrate the invention to a person of ordinary skill in the art by reference to particular embodiments of the invention, as required by 35 USC §112.

DETAILED DESCRIPTION OF THE INVENTION

Referring to FIG. 1, an exploded view illustrates an embodiment of a valve position switch 10 according to the present invention. The valve position switch 10 includes an enclosure having a case 20 and a cover 40, a sensor 50, a spring 60, a magnet 70 and a pivotable member or lever 80. The case 20 is preferably made of a plastic material through which a small magnetic field may pass. The case 20 includes a chamber 30 defined by a sidewall and a backwall. A recess in the sidewall of the case 20 forms a pivot indentation 22. The pivot indentation 22 lies open towards the opening of the case 20 and closed towards the backwall. A second recess in the sidewall of the case 20 forms a spring indentation 24. The spring indentation 24 also lies open towards the opening of the case and closed towards the backwall. Another recess forms a channel 26 in the backwall of the case 20. The channel 26 lies open towards the sidewall.

Figure 3A:
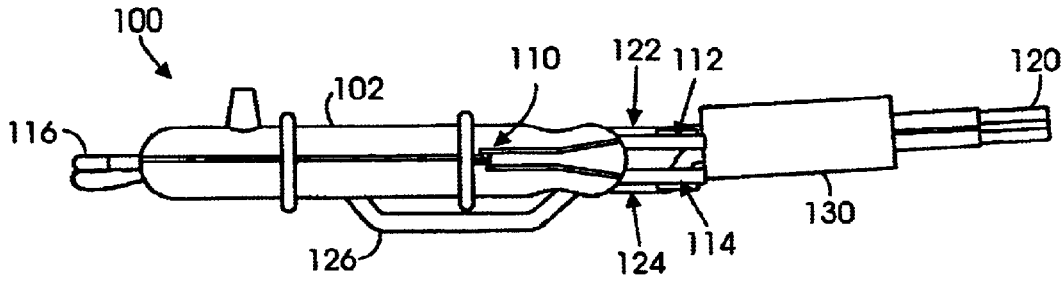
FIGS. 3A–C illustrate embodiments of sensors for use in the valve position switch according to the present invention.
Figure 3B:
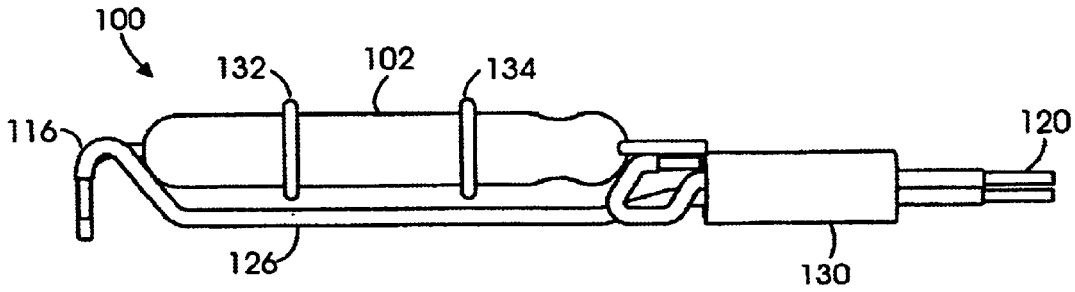
Figure 3C:
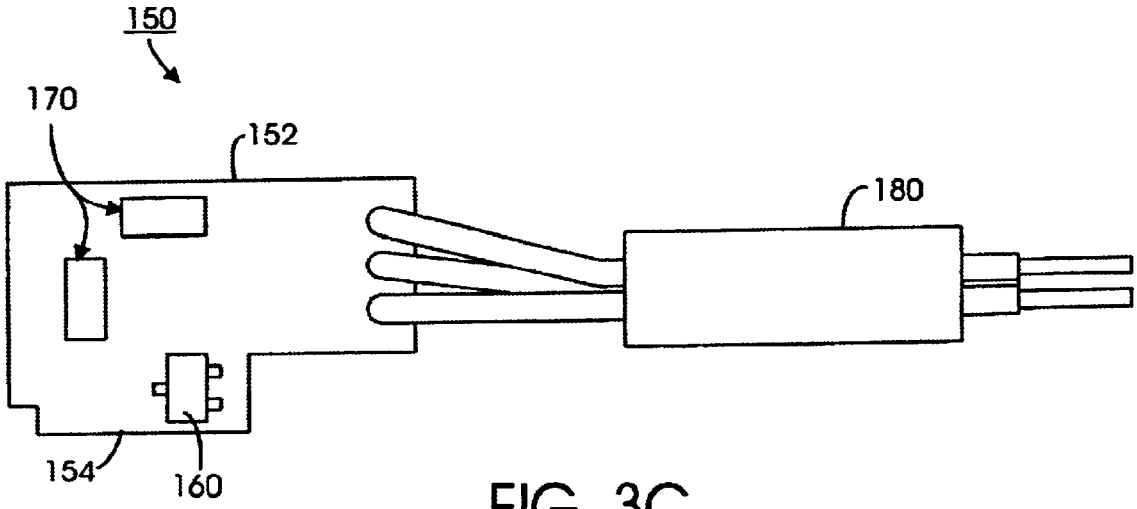

The chamber 30 receives the sensor 50 therein, which may be a reed switch as shown in FIG. 1 and FIGS. 3A–B or may be a Hall effect sensor as shown in FIG. 3C. Other sensors or transducers may be used with the present invention, including any device that can convert movement of the valve stem into an electrical signal or an electrical property (e.g. closed circuit or change in resistance). A plurality of retainers 32 and shelves 34 support the sensor 50 within the chamber 30. For a reed switch sensor as shown here, O-rings 56 and 58 may be disposed on the sensor 50 to protect and position the sensor 50 within the chamber 30. A plurality of wires 52 from the sensor 50 passes through a wire plate 36 that slides into a channel 38 in the case 20. The wires 52 may have a seal 54 with which to hold and seal the wires 52 within the wire plate 36. The chamber 30 with the sensor 50 installed may be, and preferably is, filled with a potting compound (not shown) to secure and protect the sensor 50. RTV 11 offered by General Electric, Inc. is a silicone potting compound that the applicant has found to work quite well at providing a hermetic seal for the switch 10.

The pivotable member 80 includes a pivot arm 86, one end of which installs in the pivot indentation 22. A pivot pin 88 on the end of the pivot arm 86 fits into a hole 23 in the pivot indentation 22 of the case 20 and a complimentary hole 43 in the cover 40 when attached. The spring 60 installs in the spring indentation 24 and biases the pivot arm 86 away from the sidewall of the case 20. The pivotable member 80 also includes a contact knob 84 at a distal end of the pivot arm 86. The contact knob 84 contacts a movable member (not shown) of a valve to move the pivot arm 86 about the pivot pin 88.

The pivotable member 80 has a holder 82 for holding a magnet 70. The holder 82 has a face or plate that is parallel to the backwall of the case 20 and that holds the magnet adjacent to the backwall. The holder 82 may also have a lip to further hold the magnet 70. The magnet 70 rides in a channel 26 on the backwall of the case 20. The magnet 70 is brought adjacent to the sensor 50 inside the chamber 30 to magnetically influence the sensor 50 when the pivotable member 80 is actuated.

To complete the switch and seal the sensor 50 in the chamber 30, the cover 40 attaches to the case 20. Specifically, a plurality of attachment holes 28 and 29 face the opening of the case 20. Bolts or screws (not shown) insert through the attachment holes 41 and 42 in the cover 40 and thread into the attachment holes 28 and 29 in the case 20. The cover 40 encloses the chamber 30 of the case 20 and is ultrasonically welded onto the case 20. To facilitate ultrasonic welding between the case 20 and the cover 40, the case 20 may include a thin lip 27 of material circumscribing the edge of the case 20. The cover 40 also includes a lever stop 44 that fits into the pivot indentation 22 and acts as a stop for the pivotable member 80 when pivoting. A protrusion 46 on the cover 40 closes the spring indentation 24 and further holds the spring 60 when installed in the spring indentation 24.

With the cover 40 attached and ultrasonically welded to the case 20, a sealed enclosure is created. The pivotable member 80 does not communicate directly with the sealed chamber 30. Only the magnetic flux of the magnet 70 passes through the wall of the case 20 and acts on the sensor 50. The wire plate 36 presents the only opening in the sealed enclosure. The wire plate 36, however, is properly sealed by the seal 54 on the wires 52 of the sensor 50 and by a bonding 48, such as Permabond 105 or 240.

Actuation of the pivotable member 80 occurs by contact of the contact knob 84 with a movable member (not shown). The pivot arm 86 rotates about the pivot pin 88, and the magnet 70 moves within the channel 26. As it moves within the channel 26, the magnet 70 is brought into an aligned relation to the sensor 50 within the sealed chamber 30. The magnetic flux of the magnet 70 then influences the sensor 50 to electrically indicate the position of the movable member.

When the contact knob 84 loses or changes contact with the movable member, the spring 60 that biases the pivotable member 80 extends from a compressed state and causes the pivotable member 80 to pivot away from the case 20. The magnet 70 within channel 26 then passes out of aligned relation to the sensor 50. A stop extension 89 on the pivotable member 80 contacts the lever stop 44 that resides in the pivot indentation 22 and thus stops any further movement of the pivotable member 80.

Figure 2A:
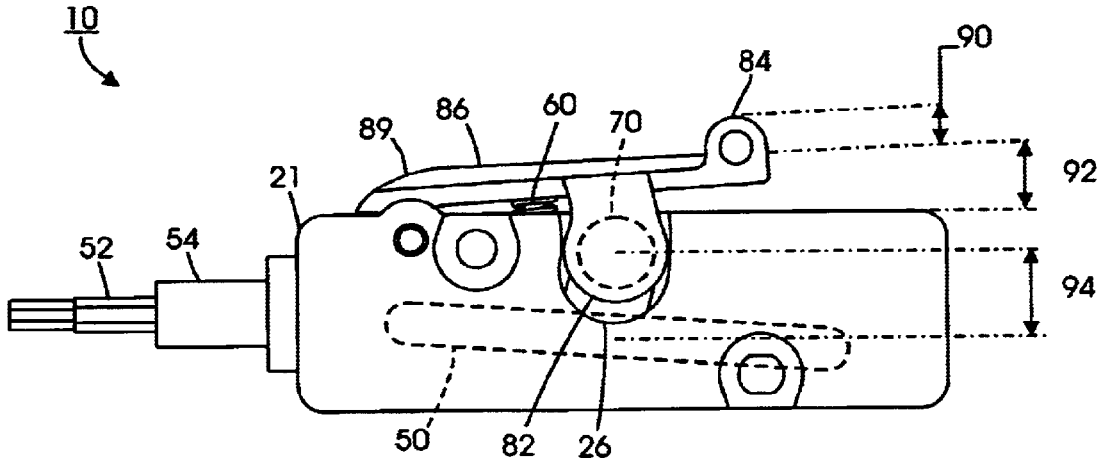
FIGS. 2A–B illustrate a side and top view respectively of the valve position switch according to the present invention.

Referring to FIG. 2A, a side view of the switch 10 illustrates the case 20 and cover 40 forming a sealed enclosure 21. Projecting from the sealed enclosure 21, the wire connection 52 communicates the sensor 50 sealed within the enclosure 21 to a controller (not shown). The stop 89 of the pivot arm 86 contacts the enclosure 21 as the biasing member 60 forces the pivot arm 86 to a fully biased position. As a result, the magnet 70 within the magnet holder 82 is situated away from the sensor 50 sealed within the enclosure 21. It is preferred that the mounting for the switch 10 is based upon the V3 standard.

FIG. 2A helps to illustrate some of the dimensions necessary for the magnet 70 to come into relation to the sensor 50 and indicate the position of a movable member (not shown) of a valve. The contact knob 84 of the pivot arm 86 is approximately a distance 92 from the sidewall of the sealed enclosure 21 when the spring fully biases the pivotable member 80. It is desirable that the contact knob 84 and not the pivot arm 86 come into contact with the movable member. For this reason, the contact knob 84 projects a distance 90 above the surface of the pivot arm 86 and contacts the movable member when the movable member positioned at least a combined distance 90+92 from the sidewall of the enclosure 21. Having the movable member positioned anywhere closer than the distance 92 from the sidewall of the enclosure 21 will cause the movable member to contact the pivot arm 86 and cause improper indication by the sensor 50 or damage to the switch 10.

Additionally, the magnet 70 rests in the holder 82 of the pivotable member 80 and rides within the channel 26 of the enclosure 21. The distance to effectively bring the magnet 70 adjacent to the reed switch or sensor 50 is shown as a distance 94. Distance 94 is no more than the pivoting of the pivot arm 86 from its fully biased position to a position where the pivot arm 86 contacts the surface of the enclosure 21.

Figure 2B:
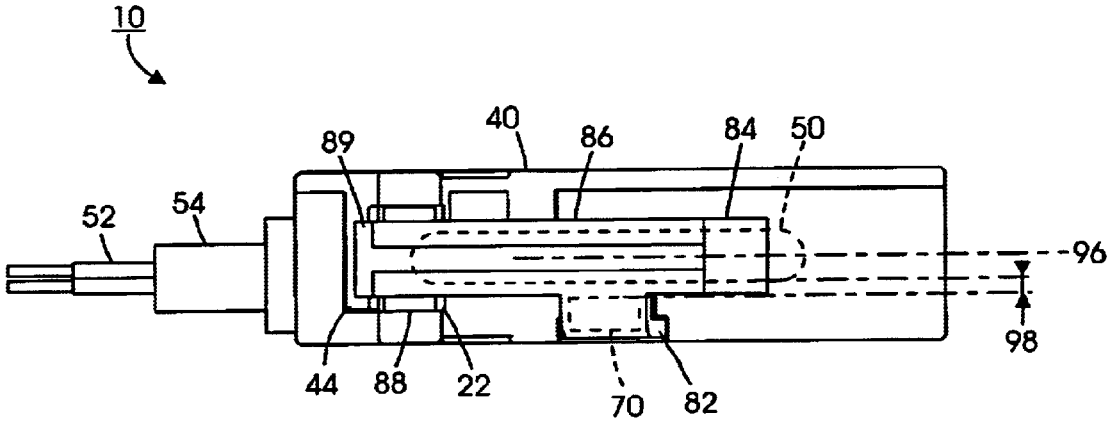

Referring to FIG. 2B, a top view illustrates the valve position switch 10 of the present embodiment. The top view helps to illustrate how the magnet 70 and sensor 50 are oriented with respect to one another. On one end of the pivot arm 86, the pivot end 88 fits into the pivot indentation 22 formed from the case 20 and attached cover 40. The stop 44 of the cover 40 is disposed under the extended stop 89 of the pivot arm 86. The biasing member situates between the pivot arm 86 and the case 20 and acts rectilinearly on the pivot arm 86.

On the other end of the pivot arm 86, the holder 82 lies off the axial centerline 96 of the pivot arm 86. The magnet 70 is held adjacent to the backwall by the face or plate of the holder 82 where it rides within the channel 26. On the other side of the wall of the case 20, the sensor 50 situates parallel to the magnet 70 at a predetermined distance 98. The distance 98 is determined such that the magnetic field is sufficient to influence the sensor 50 through the backwall of the case 20. For example, the backwall may have a thickness of approximately 0.06", and the magnet may have a diameter of 0.25" and a thickness of 0.125".

In particular, the strength of the magnetic field through the backwall must be able to move the reeds of a reed switch at the distance 98. Furthermore, if a Hall effect sensor is used, the Hall effect transducer must receive sufficient magnetic flux from the magnet 70 when the transducer aligns with the magnet 70 through the backwall of the case 20. Typical Hall effect transducers may be sensitive to ±100 gauss, or even ±2500 gauss, and may provide an output from 1 mV/gauss to 25 mV/gauss. A particular gap 98 and a lateral distance 94 may be calibrated between the magnet 70 and the sensor 50 to produce the required sensing ability of the switch 10. The required calibration and circuitry of the present invention is within the ordinary skill of one in the art.

Referring to FIGS. 3A–B, an arrangement of a reed switch 100 is illustrated for use in the switch of the present invention. The reed switch 100 is of conventional construction and includes an encapsulation 102 of glass around which two O-rings 132 and 134 are placed. The encapsulation 102 contains a plurality of flexible reeds 110 of magnetizable material disposed therein. The reeds 110 are arranged so that they overlap for a short distance and connect to separate conductor pins 112, 114 and 116 at ends of the capsule 102. The pins are cut to provide attachment of the reed switch 100 within the chamber of the valve position switch (not shown).

A plurality of wires 122, 124 and 126 attach to the pins. The wires form a cable 120, which has a seal 130. As is understood within the art that the contacts for a reed switch 100 may be opened or closed by appropriate movement of a permanent magnet (not shown) in order to influence and move the reeds 110 with a magnetic field. The reeds may be composed of tungsten for high power applications or composed of rhodium for Information System applications. Other magnetizable materials may be used as well.

Referring to FIG. 3C, another sensor 150 is illustrated for use in the valve position switch according to the present invention. The sensor 150 includes a printed circuit board 152, which is properly contoured to position securely within the chamber of the switch (not shown). The printed circuit board 152 may include profiles, such as a cutout 154, to accommodate the attachment holes for the case and cover of the switch. A Hall effect transducer 160 and other necessary electronics 170, such as an amplifier, are contained on the printed circuit board 152. As is known in the art, magnetic flux acting on adjacent, non-magnetic plates (not shown) of the Hall effect transducer 160 creates a measurable voltage potential between the plates. The location of the Hall effect transducer 160 is such that the magnet (not shown) may be brought into proper aligned relation to the transducer 160 to create an electrical signal. Hall effect switches are preferably used for bus system applications.

Figure 4A:
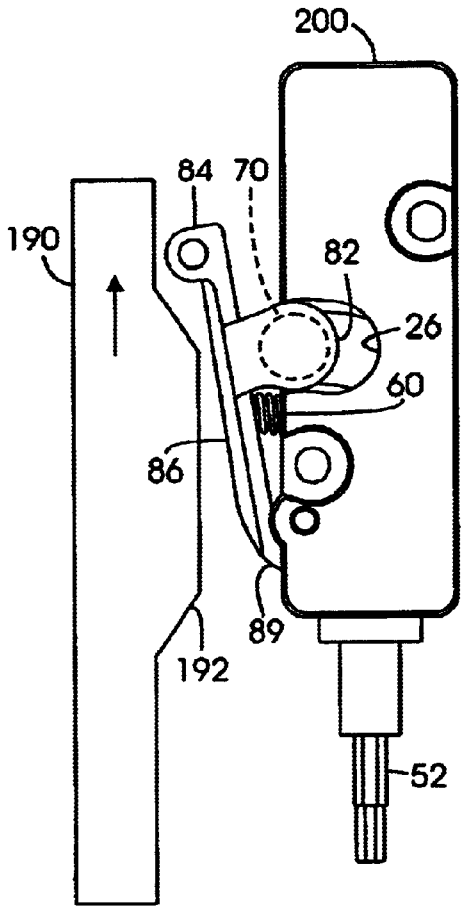
FIGS. 4A–B illustrate operation of the valve position switch in relation to a linear movable member.
Figure 4B:
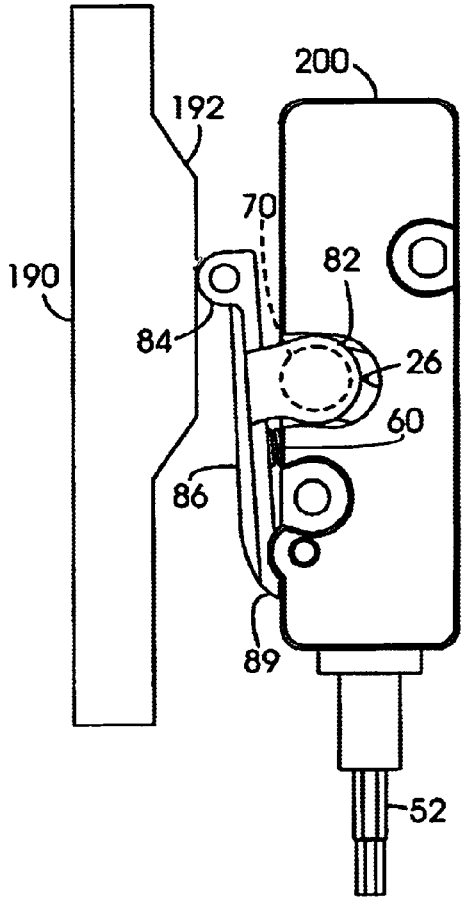

Referring to FIGS. 4A–B, operation of the valve position switch 200 is illustrated in relation to a linear movable member 190. The linear movable member 190 may be, for example, a stem of a valve. The body 190 has an actuator 192 that slightly projects from the surface of the body. The actuator 192 contacts the switch 200 when the linear movable member 190 attains a predetermined position relative to the switch 200. The predetermined position typically corresponds to a fully closed or fully open valve.

In FIG. 4A, the linear movable member 190 is shown as the actuator 192 approaches the switch 200. The switch 200 is properly spaced so that the actuator 192 does not contact the pivot arm 86. The actuator 192 is intended to strike only the contact knob 84 on the switch 200. The biasing member 60 forces the pivot arm 86 to the position shown. The extended end 89 of the arm 86 contacts the stop on the switch 200 to keep the pivot arm 86 from extending any further.

In FIG. 4B, the linear movable member 190 is shown as the actuator 192 contacts the contact knob 84 on the switch 200. The pivot arm 86 pivots towards the casing of the switch 200, and the magnet holder 82 slides in the channel 26. As a result, the magnet 70 is brought into aligned relation to the sensor (not shown) within the casing of the switch 200, and an electrical circuit is completed. The electrical signal carries through the connection wires 52 and indicates that the position of the linear movable member 190 has reached the predetermined location.

Figure 5A:
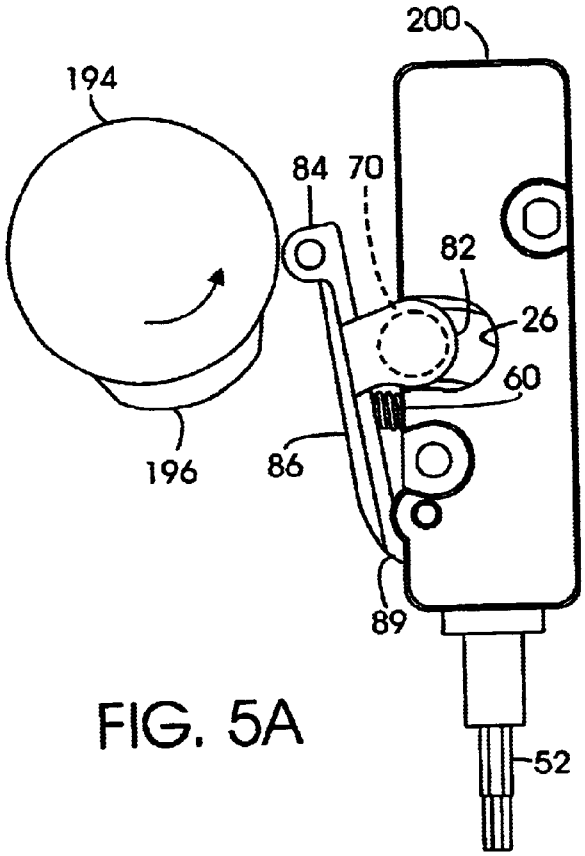
FIGS. 5A–B illustrate operation of the valve position switch in relation to a rotating body.
Figure 5B:
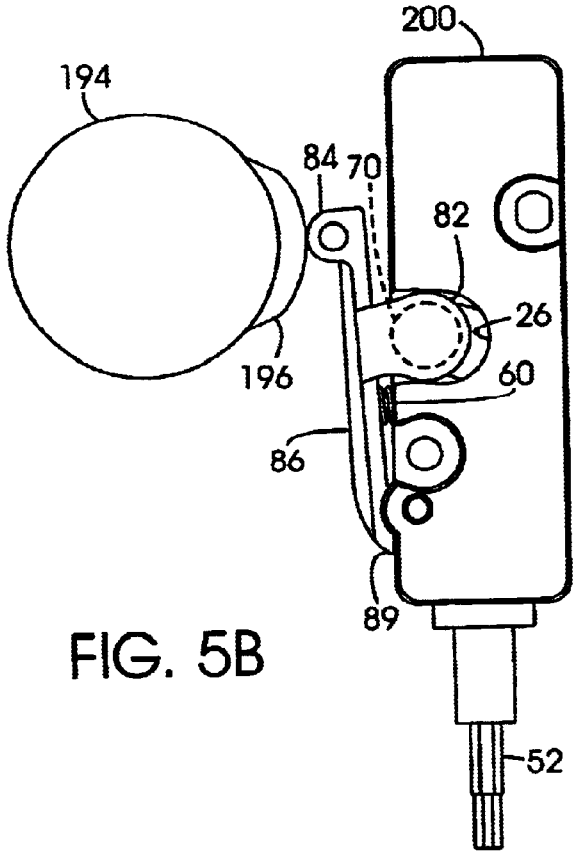

Referring to FIGS. 5A–B, operation of the valve position switch 200 is illustrated in relation to a rotating body 194. The rotating body 194 may be, for example, a rotating stem of a valve. The rotating body 194 has an actuator 196 that slightly projects from the surface of the body 194. The actuator 196 contacts the switch 200 when the rotating body 194 attains a predetermined position relative to the switch 200. The predetermined position typically corresponds to a fully closed or fully open valve.

In FIG. 5A, the rotating body 194 is shown as the actuator 196 approaches the switch 200. The switch 200 is properly spaced so that the actuator 196 does not contact the pivot arm 86. The actuator 196 is intended to strike the contact knob 84 on the switch 200. The biasing member 60 forces the pivot arm 86 to the position shown. The extended end 89 of the arm 86 contacts a stop on the switch 200 to keep the pivot arm 86 from extending any further.

In FIG. 5B, the rotating body 194 is shown as the actuator 196 contacts the contact knob 84 on the switch 200. The pivot arm 86 pivots towards the casing of the switch 200, and the magnet holder 82 slides in the channel 26. As a result, the magnet 70 is brought into aligned relation to the sensor (not shown) within the casing of the switch 200, and an electrical circuit is completed. The electrical signal carries through the connection wires 52 and indicates that the position of the rotating body 194 has reached the predetermined location.

The foregoing description of preferred and other embodiments of the present invention is not intended to limit or restrict the breadth, scope or applicability of the invention that was conceived of by the Applicant. In exchange for disclosing the inventive concepts contained herein, the Applicant desires all patent rights afforded by the appended claims.

What is claimed is:

1. An electric device for indicating a position of a movable member, comprising:

an enclosure having a hermetically sealed chamber defined by a first wall and an adjacent second wall;

a lever pivotally attached to the enclosure and having a permanent magnet adjacent the second wall, the magnet being movable with the lever between a first and a second position;

a biasing member that biases the lever and magnet to the first position; and a sensor located within the chamber and capable of being influenced by the magnet when it is moved into the second position through contact of the lever with the movable member, wherein the sensor comprises wires passing through a sealed wire plate attached to the enclosure.

2. The electrical device of claim 1, wherein the sensor comprises a reed switch.

3. The electrical device of claim 1, wherein the sensor comprises a Hall effect sensor.

4. The electrical device of claim 1, wherein the lever comprises a holder having a face parallel to second wall for receivably securing the magnet adjacent to the second wall of the enclosure.

5. The electrical device of claim 4, wherein the enclosure further comprises a channel outside of the chamber for receiving the holder and magnet therein.

6. The electrical device of claim 5, wherein the biasing member comprises a spring disposed between the enclosure and the lever.

7. An electric device for indicating a position of a movable member, comprising:

an enclosure having a hermetically sealed chamber defined by a first wall and an adjacent second wall, wherein the enclosure comprises a first portion that is ultrasonically welded to a second portion;

a lever pivotally attached to the enclosure and having a permanent magnet adjacent the second wall, the magnet being movable with the lever between a first and a second position;

a biasing member that biases the lever and magnet to the first position; and a sensor located within the chamber and capable of being influenced by the magnet when it is moved into the second position through contact of the lever with the movable member.

8. The electrical device of claim 7, wherein the sensor comprises a reed switch.

9. The electrical device of claim 7, wherein the sensor comprises a Hall effect sensor.

10. The electrical device of claim 7, wherein the lever comprises a holder having a face parallel to the second wall for receivably securing the magnet adjacent to the second wall of the enclosure.

11. The electrical device of claim 10, wherein the enclosure further comprises a channel outside of the chamber for receiving the holder and magnet therein.

12. The electrical device of claim 11, wherein the biasing member comprises a spring disposed between the enclosure and the lever.

13. A limit switch for indicating the state of a valve, comprising:

an enclosure having a sealed chamber defined by a first wall and an adjacent second wall;

an arm having one end pivotally attached to the first wall;

a receptacle on the arm for holding a magnet adjacent to the second wall;

a biasing member disposed between the arm and the first wall of the enclosure; and a sensor disposed in the chamber adjacent to the second wall and magnetically influencable to indicate the position of the valve member when the magnet is pivoted with the into an aligned relation with the sensor.

14. The limit switch of claim 13, wherein the sensor is a reed switch.

15. The limit switch of claim 13, wherein the sensor is a Hall effect sensor.

16. The limit switch of claim 13, wherein the enclosure comprises a case and a cover that are ultrasonically welded together.

17. The limit switch of claim 13, wherein the sensor has one or more wires passing through a wire plate sealably attached to an opening defined in the first wall.

18. The limit switch of claim 13, wherein the receptacle comprises a face parallel to the second wall to hold the magnet.

19. The limit switch of claim 18, wherein the plate of the receptacle comprises a lip to retain the magnet on the receptacle.

20. The limit switch of claim 19, wherein the second wall comprises a channel receiving the magnet in the receptacle of the arm.

21. A method for indicating a predetermined position of a movable member, comprising:

attaching one end of an arm to a first wall of an enclosure;

holding a magnet on the arm adjacent to a second wall of the enclosure by disposing the magnet between the second wall and a plate attached to the arm and parallel to the second wall;

sealing a sensor within the enclosure adjacent to the second wall;

pivoting the magnet in relation to the sensor by contacting the movable member with the arm;

electrically indicating that the movable member has attained the predetermined position when the magnet is in an aligned relation to the sensor; and biasing the pivot arm and magnet away from the aligned relation to the sensor when the movable member is not at the predetermined position.

22. The method of claim 21, wherein electrically indicating that the movable member has attained a predetermined position comprises magnetically influencing a Hall effect sensor within the enclosure.

23. The method of claim 21, wherein electrically indicating that the movable member has attained the predetermined position comprises magnetically influencing reeds in a reed switch within the enclosure.

* * * * *

UNITED STATES PATENT AND TRADEMARK OFFICE

CERTIFICATE OF CORRECTION

PATENT NO. : 6,650,211 B2
DATED : November 18, 2003
INVENTOR(S) : Pimouguet

It is certified that error appears in the above-identified patent and that said Letters Patent is hereby corrected as shown below:

Column 7,
Line 48, please insert -- arm-- before “into”.

Signed and Sealed this

Third Day of February, 2004

JON W. DUDAS
*Acting Director of the United States Patent and Trademark Office*